US008104861B2

(12) United States Patent
Saettel et al.

(10) Patent No.: US 8,104,861 B2
(45) Date of Patent: Jan. 31, 2012

(54) COLOR TO COLOR REGISTRATION TARGET

(75) Inventors: John J. Saettel, Trotwood, OH (US); Rodney G. Mader, Springfield, OH (US)

(73) Assignee: Eastman Kodak Company, Rochester, NY (US)

( * ) Notice: Subject to any disclaimer, the term of this patent is extended or adjusted under 35 U.S.C. 154(b) by 312 days.

(21) Appl. No.: 12/568,750

(22) Filed: Sep. 29, 2009

(65) Prior Publication Data

US 2011/0074861 A1 Mar. 31, 2011

(51) Int. Cl.
*B41J 29/393* (2006.01)

(52) U.S. Cl. ..... 347/19

(58) Field of Classification Search ..... 347/5, 19; 101/183

See application file for complete search history.

(56) References Cited

U.S. PATENT DOCUMENTS 5,018,213 A 5/1991 Sikes
5,452,073 A 9/1995 Kataoka
6,317,147 B1 * 11/2001 Tanaka ..... 347/116
6,499,402 B1 12/2002 Sikes et al.
7,515,267 B2 * 4/2009 Ehbets et al. ..... 356/416
8,017,927 B2 * 9/2011 Shakespeare et al. ... 250/559.04

FOREIGN PATENT DOCUMENTS

EP 0 729 846 9/1996

OTHER PUBLICATIONS

J. J. Saettel et al., "A Calibration System for Multi-Printhead Ink Systems", U.S. Appl. No. 12/568,713, filed Sep. 29, 2009.

J. J. Saettel, "Automated Time of Flight Speed Compensation", U.S. Appl. No. 12/568,733, filed Sep. 29, 2009.

J. J. Saettel et al., "Exposure Averaging", U.S. Appl. No. 12/568,762, filed Sep. 29, 2009.

* cited by examiner

*Primary Examiner* — An Do

(74) *Attorney, Agent, or Firm* — Peyton C. Watkins

(57) ABSTRACT

A method for calibrating a multi-color inkjet printing system includes using a 3×2 test target array. The test target includes printing a first color three times in which two of the three colors are aligned along a first axis and the third is offset from the first axis and at a midway point between the other two test marks along the other axis. A second test color is aligned with at least one of the first colors along both axes.

9 Claims, 8 Drawing Sheets

COLOR TO COLOR REGISTRATION TARGET

CROSS REFERENCE TO RELATED APPLICATIONS

Reference is made to commonly assigned U.S. patent application Ser. No. 12/568,762 filed Sep. 29, 2009 by John Saettel, entitled "Exposure Averaging", commonly assigned U.S. patent application Ser. No. 12/568,713 filed Sep. 29, 2009 by John Saettel, entitled "A Calibration System For Multi-Printhead Ink Systems", the disclosures of which are herein incorporated by reference, and commonly assigned U.S. patent application Ser. No. 12/568,733 filed Sep. 29, 2009 by John Saettel, entitled "Automated Time of Flight Speed Compensation".

FIELD OF THE INVENTION

The present invention generally relates to inkjet printing systems and, more particularly, to such inkjet systems that uses test registration targets having color to color registration.

BACKGROUND OF THE INVENTION

High-speed, multi-color printing systems print test patterns that are subsequently captured for use in calibration and the like. A camera and strobe are synchronized so that a test pattern is captured for use in analyzing whether there is any mis-registration within the printing process. U.S. Pat. No. 5,018,213 discloses one such registration test pattern. In this disclosure, each printhead prints at least two test marks in the test pattern array. In other words, in the minimum-sized array of test registration colors, there are at least two of each test registration colors. In analyzing the registration test pattern, "each dot pair of the mark is identified by scoring various attributes of possible dot pairs including color, size and positions." (see Abstract)

Although the above-described method is satisfactory, improvements are always desired. One such improvement is to use less area of the print media for printing test targets and not duplicating each test color with the test target array. The present invention provides such improvements.

SUMMARY OF THE INVENTION

The present invention is directed to overcoming one or more of the problems set forth above. Briefly summarized, according to one aspect of the invention, the invention resides in a method for aligning image planes in a multiple print-head system, wherein each print-head has an associated image plane, the method comprising the steps of (a) defining a test pattern having marks A, B and C at three intended locations a (1), b (3) and c (5) in the image plane in which the location b (3) is aligned to a first axis of the image plane relative to the location a (1), and the location c (5) is aligned at a first predetermined distance between the locations a (1) and b (3) and offset from the axis by a second predetermined distance along a second axis of the image plane; (b) further defining the test pattern with a mark D at an intended location d in the second image plane (2, 4 and 6) such that the location d of the second image plane corresponds to a position aligned along a first axis with one of the mark locations a, b and c and aligned along the second axis, but not aligned along the first axis, with a second one of the mark locations a, b and c; (c) printing the test pattern using the multiple print-head system on the test media; (d) using an imaging detector to capture an image of the printed test pattern; (e) determining detected locations a', b' c' and d' of the printed marks A, B, C in the first image plane and D in the second image plane in the printed test pattern; (f) determining deviation of the detected location d' of the mark D of the second image plane relative to the detected locations a', b' and c' of the marks A, B and C of the first image plane from the captured image.

It is an object of the present invention to minimize the area used for printing test targets.

This object is achieved by not printing a duplicate of each test color.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

Figure 1:
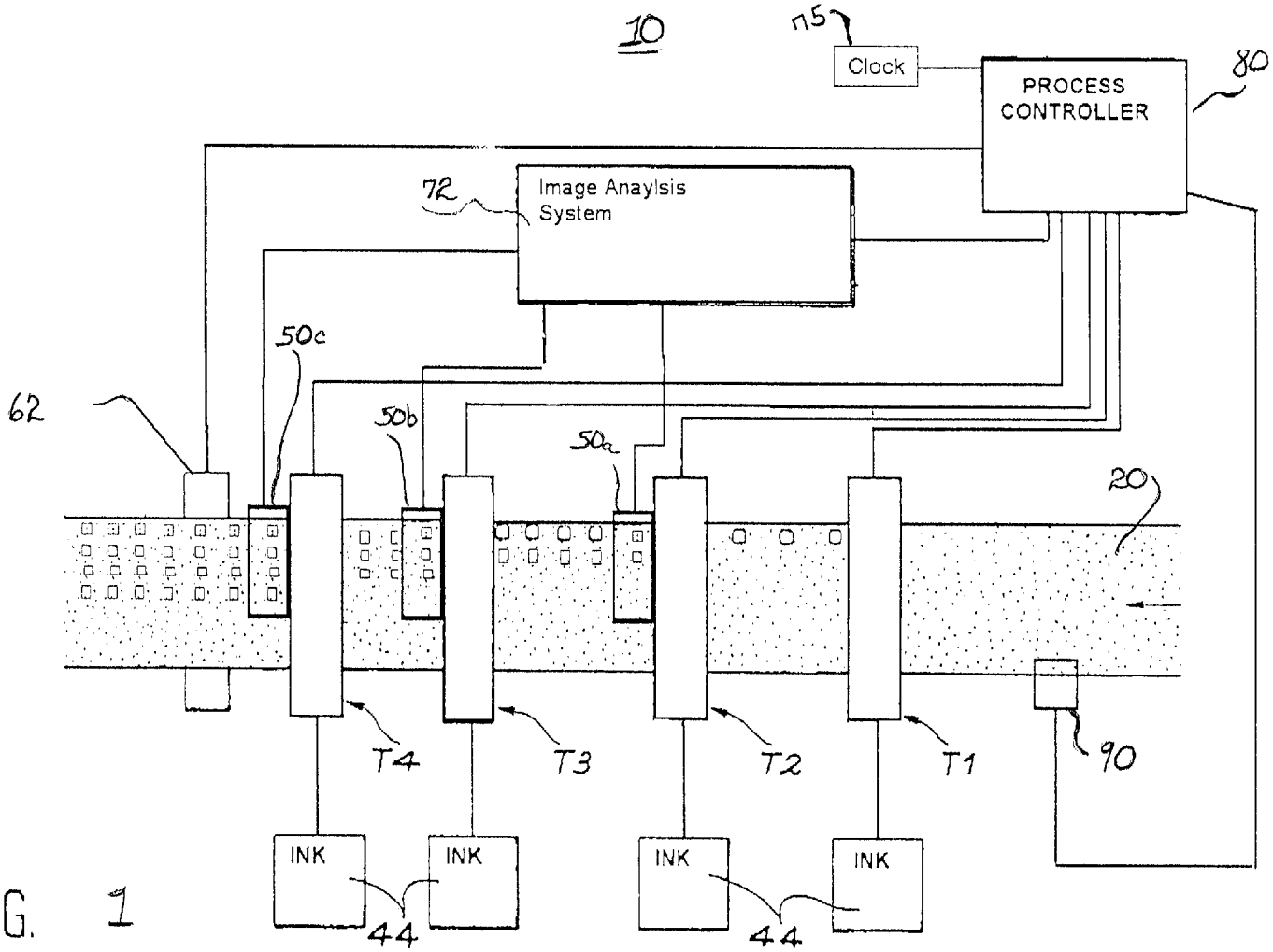
FIG. 1 is a block diagram of the calibration system of a multi-printhead printing system of the present invention.
Figure 2A:
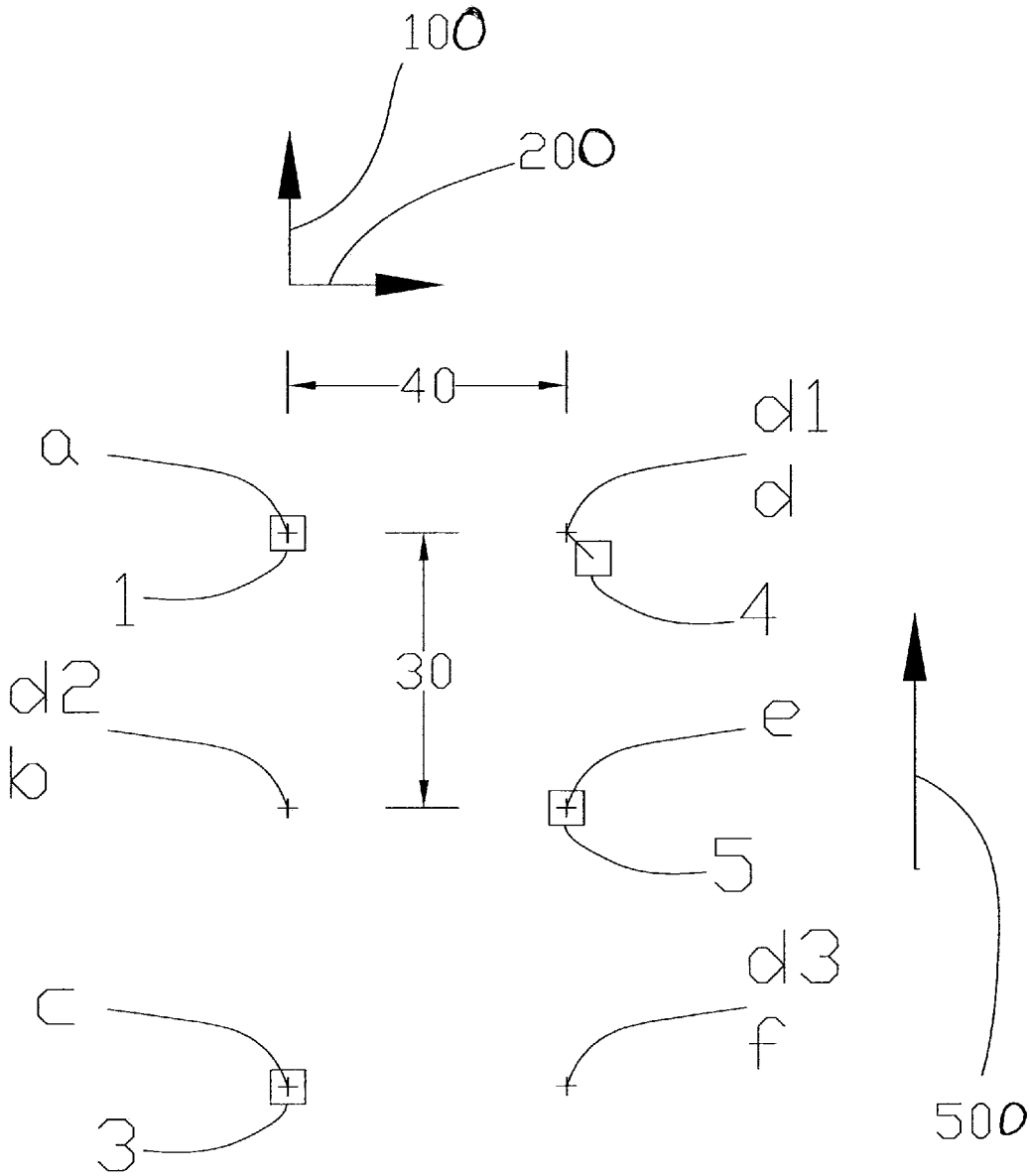
FIG. 2*a*-2*c* are diagrams illustrating intended locations of printed test marks and printed marks at the respective locations.

Turning now to FIG. 1, there is shown a block diagram of the printing system 10 of the present invention. The printing system 10 includes a transport for transporting the print media 20 through various stages of the printing process. Four printheads (T1, T2, T3 and T4) span over the print media 20 each for dispensing ink of a different color on the print media 20 as the media 20 moves relative to the printheads T1-T4. In the preferred embodiment, each printhead T1-T4 prints test marks (preferably each test mark is a 5×5 pixel array) so that, after printing by the last printhead T4, a 2×3 array of test marks are printed as shown in FIG. 2*a*, which is discussed in detail hereinbelow. Referring back to FIG. 1, four ink holding receptacles 44, each of a different color, are respectively attached to each printhead T1-T4 for supplying ink thereto. Three image capture devices 50*a*, 50*b* and 50*c* are respectively disposed immediately downstream and in close proximity of each of the last three printhead T2-T4 but not the first printhead T1. Each image capture device 50*a*, 50*b* and 50*c* includes a digital camera and a light source. Typically the light sources are strobe lights for producing a plurality of short bright flashes of light to allow an image to be captured without motion blur. Typically the strobe lights consist of a plurality of Light Emitting Diodes (LEDs), commonly of red, green and blue LEDs that are the color compliments of cyan, magenta, and yellow inks, respectively, that are printed by the printheads. By using LEDs that are the color complement of the color inks, image contrast is enhanced. For example, a yellow mark on the print media will appear as a high contrast dark mark when illuminated only with a blue LED. Black ink which absorbs all colors shows up in high contrast with any visible light LED so a separate LED is not needed for the black ink. Each image capture device 50*a*-50*c* captures an image of the media 20 after the printhead T2-T4 prints its respective ink on the media 20 for providing feedback as to whether calibration of the printing system is needed and, if so, the degree of calibration to be preformed, as described in commonly-assigned and co-pending U.S. patent application Ser. No. 12/568,713. A drive motor (not shown) connected to a drive roller 62 exerts force on the print media for moving it through the printing system 10.

The printing system 10 includes various components that perform process control and analysis. In this regard, an image system analyzer 72 receives the images captured by the image capture devices 50*a*-50*c* respectively located downstream of each printhead T2-T4 to determine whether the ink marks printed by the respective printheads T1-T4 are aligned relative to each other as expected if aligned properly. In general, the image system analyzer 72 converts the images into bit maps, identifies each of the test marks, and determines their locations within the image, and calculates their alignment relative to each other in both the x and y directions, if any. Based on the result, the image system analyzer 72 sends a signal to the process controller 80. The printing system also includes a clock 75 that creates a clock pulse train. The clock 75 communicates with the process controller 80, which, if necessary, uses the clock pulse train to create a frequency shifted pulse train for each of the printheads T2, T3 and T4. It is noted that, in a four ink system, three images are captured with the initial ink mark not being imaged alone as there is no relative relationship by which the initial mark may be analyzed for correctness.

An encoder 90 is used to monitor the motion (in the direction of the arrow) of the print media 20 through the printing system 10. Typically the encoder 90 is in the form of a rotary encoder that creates a defined number of pulses per revolution. The rotary encoder is connected to a roller or wheel (not shown) that is rotated by the moving paper. The circumference of the wheel or roller, in combination with the defined number of pulses per revolution of the rotary encoder 90, determines the number of encoder pulses per centimeter or inch of paper travel. The output of the encoder 90, in the form of an encoder pulse train, is used by the process controller 80 for controlling the placement of the print media 20 along the direction of print media travel. Typically the spacing of pixels in the in-track direction (along the direction of paper motion) corresponds to N times the spacing between encoder pulses, where N is a small (<10) integer. To properly print a multicolor document, the print data sent to each printhead T2-T4 downstream of the first printhead T1 must be delayed by increasing amounts relative to the data of first printhead. These delays are normally defined in terms of a delay count or the number of the encoder pulses that correspond to the spacing along the paper path of the printheads T2-T4 from the first printhead T1. For example, if the second printhead T2 is located 8.5 inches downstream of the first printhead T1 and the encoder 90 produces 600 pulses per inch, the print data to the second printhead T2 would be delayed by 5100 pulses relative to the data to the first printhead T1.

The print media 20 passes under and in the optical path of the image capture devices 50*a*-50*c*, such as a digital camera, in order to capture the printed test marks from the printheads T1-T4. Various digital cameras can be employed provided they have sufficient optical resolution and light sensitivity to capture images of the test marks. One such useful camera is the IMP-VGA210-L from Imperx. This is a black and white camera with a 640×480 pixel resolution. It is able to output images at a rate of 210 complete frames per second through a CameraLink™ interface to an image processing system. This camera also has an external trigger and an externally controllable electronic shutter so that acquisition of images and the shutter time for acquiring an image can be controlled by the process controller 80. This camera also allows a portion of the active pixels in the captured image frame to be defined as an area of interest. The camera sensor then uses only that portion of its active pixels for image capture, and only transfers the image data corresponding to that area of interest to the image system analyzer 72. By so doing, the camera is able to capture and transfer partial frame images at higher frame rates than its complete frame rate. An infinite conjugate micro-video lens from Edmund Optics, #56776, with a 25 mm focal length and a 1:1 magnification is an effective lens for use with this camera. In one embodiment, the strobe lights are light emitting diodes, two LED's each of red, green and blue, arranged circular around the lens of the camera. Light emitting diodes from Luxeon, such as LXHL-PH09, LXHL-PM09, and LXHL-PRO09, are examples of usable LED's. The image capture device may be mounted on a carriage downstream of each printhead so that the image capture device is adjustable in position in a cross-track direction. Alternatively, the image capture device may be mounted directly to downstream side of the printhead so that it can capture the image of the test marks printed by that printhead and the first printhead.

During the printing process however, it is possible for the effective spacing between the printheads T1-T4 to vary, due, for instance, to stretching of the print media 20, resulting in mis-registration of the images from the various printheads T1-T4. If by means of the image capture device and the image processing unit such a registration error is detected, the process controller 80 can modify the operation of the printing system 10 to correct for this mis-registration as described in commonly-assigned and co-pending U.S. patent application Ser. No. 12/568,713.

Figure 2B:
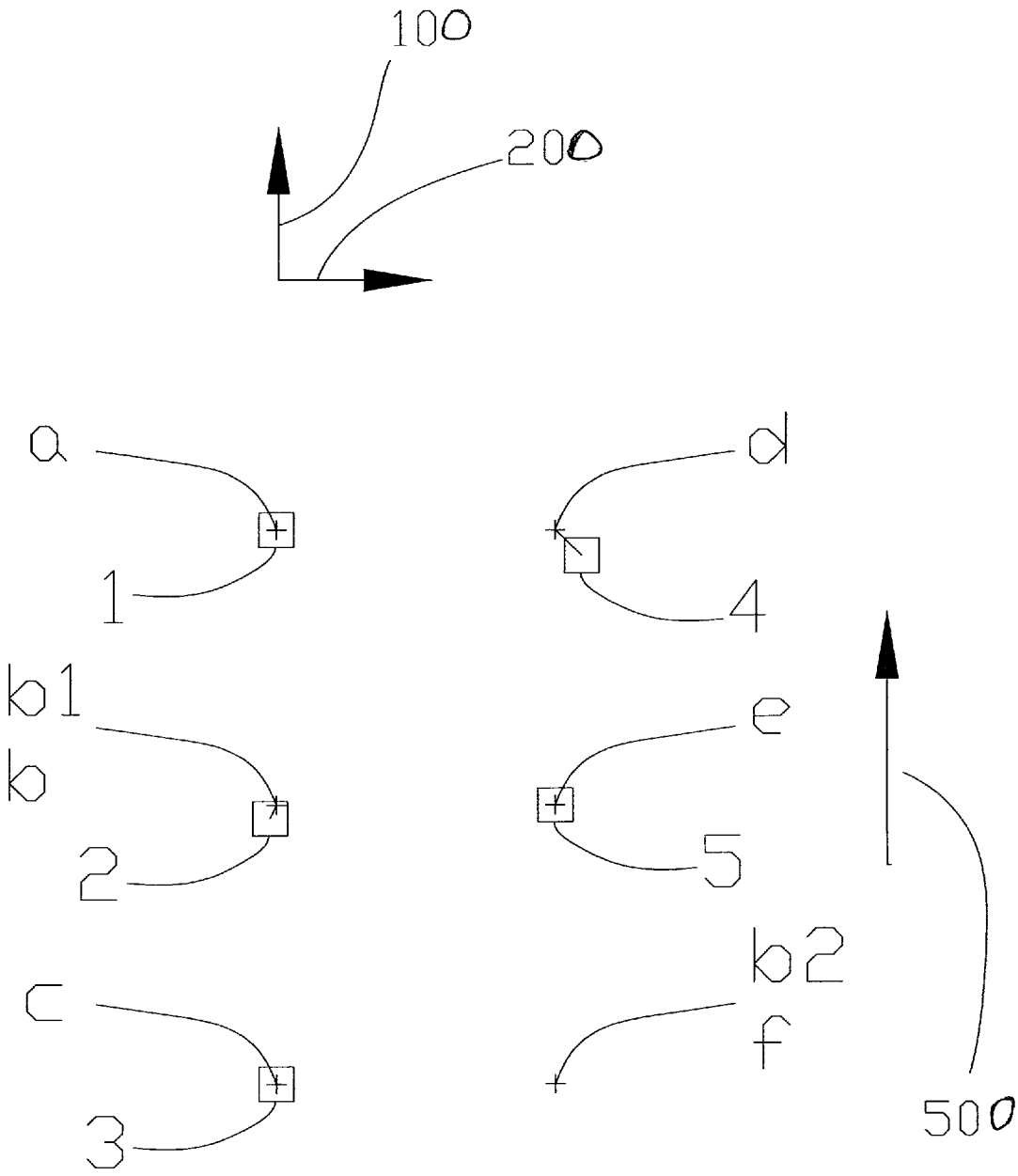
Figure 2C:
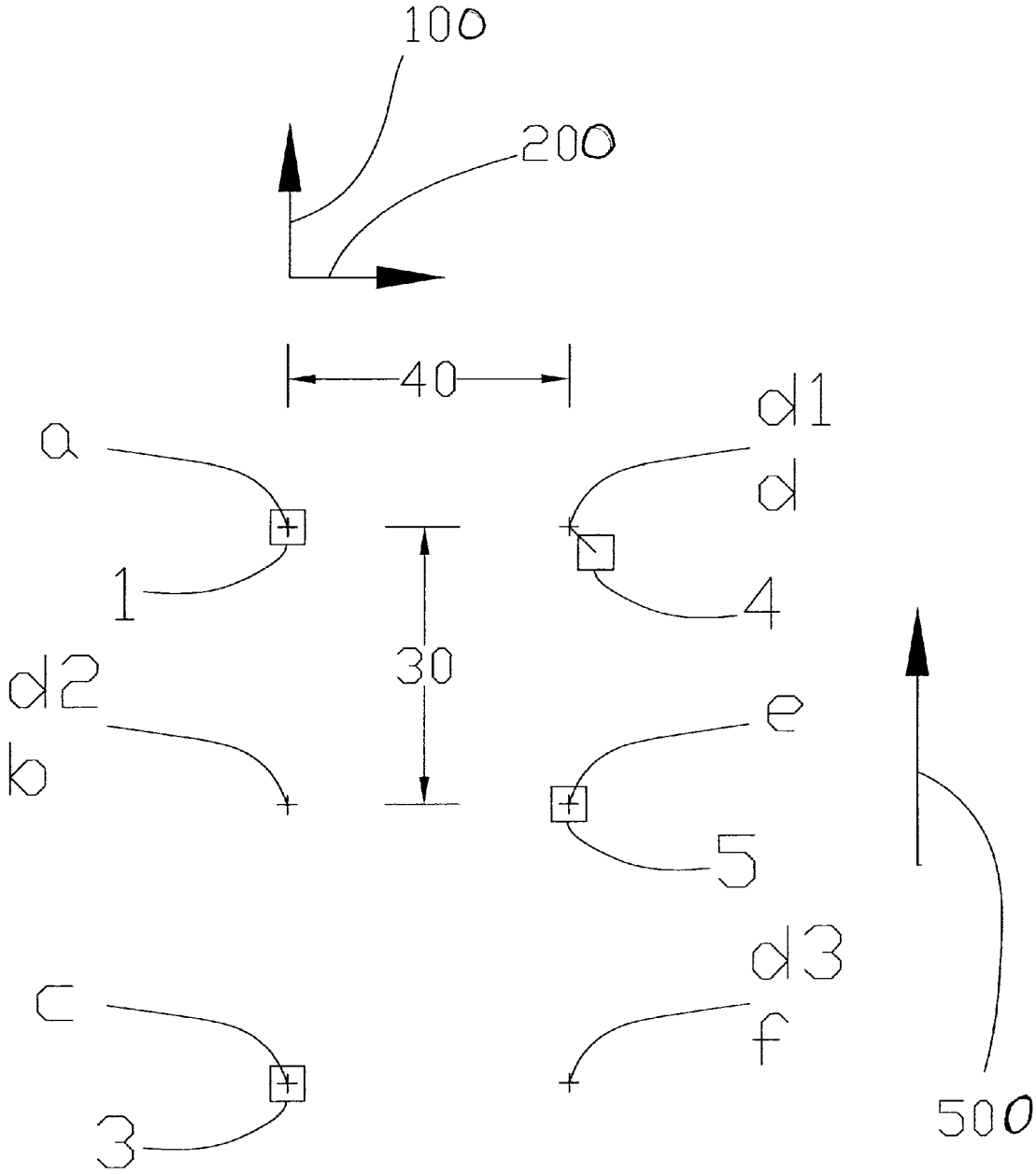

Before discussing FIGS. 2*a*-2*c*, it is noted that, due to nature of the present invention, some parts in the drawing are given two reference numerals. This will become apparent as each figure is discussed.

Referring to FIG. 2*a*, there is shown a test pattern printed by the printheads according to the invention. The test pattern has intended locations a-f at which print marks are to be made. Intended locations a, b, and c all lie on a line that is aligned to a first axis 100 of the image planes. Similarly intended locations d, e, and f lie on a line that is aligned parallel to the first axis of the image plane. The first axis is shown aligned with the direction of relative motion between the print media and the printheads as denoted by the arrow 500. (Alternatively the first axis could be aligned with the cross track direction, perpendicular to the direction of relative motion between the print media and the printheads.) Each of the pairs of intended locations a and d, b and e, and c and f are aligned parallel with a second axis 200 of the image planes that is perpendicular to the first axis 100. The b and e pair of intended locations are at a first predetermined distance 30 along the first axis 100 between the locations a and c. Preferably the first predetermined distance 30 corresponds to the midpoint between the locations a and c, or to substantially the midpoint between the intended locations a and c. The intended locations d, e, and f are offset by a second predetermined distance 40 along a second axis from the corresponding intended locations a, b, and c.

The printhead T1, which prints the reference color or reference image plane, prints cyan at three marks, 1, 3, and 5 and intended locations a, c, and e. Printhead T2 prints yellow mark 4 with an intended location of d1. Location d1 is aligned along a first axis with intended location e, and is aligned along a second axis, but not along the first axis with intended location a. Alternatively, test mark 4 could have been printed with intended locations d2 or d3. At each of the possible intended locations d1, d2, and d3, referred to as intended location d, location d is aligned along a first axis with one of the intended locations a, c, and e corresponding to marks printed by the reference color and location d is aligned along a second axis, but not along the first axis with a second one of the mark location a, c, and e. Test mark 4, however, was not printed at the intended location d, but rather printed to the right and below the intended location. This is indicative of a misregistration of the image plane printed by printhead T2 relative to the image plane of printhead T1.

Referring to FIG. 2*b*, printhead T3 prints magenta test mark 2 with an intended location b. FIG. 2*b* illustrates that intended location b could correspond to intended locations b1 or b2. Intended location b, like intended location d, is aligned along a first axis with one of the intended locations a, c, and e corresponding to marks printed by the reference color and intended location b is aligned along a second axis, but not along the first axis with a second one of the mark location a, c, and e. Intended location b and intended location d, however must be distinct from each other. Since location d was selected to be location d1 of FIG. 2*a*, location b couldn't be placed there. Test mark 2 is misaligned down and to the left of intended location b1 in FIG. 2*b*.

Similarly, printhead T4 prints black test mark 6 with an intended location f, as shown in FIG. 2*c*. Intended location f is aligned along a first axis with one of the intended locations a, c, and e, corresponding to marks printed by the reference color, and intended location f is aligned along a second axis, but not along the first axis with a second one of the mark location a, c, and e. Intended location f is distinct from intended location of all the other intended locations. In this example test mark 6 is misaligned above its intended location f.

Cyan test mark 5 is preferable at the mid-point between cyan test marks 1 and 3. These locations are predetermined locations at which the test marks are to be printed in order to detect mis-registration. If they are not aligned as expected, it is then known that mis-registration has occurred. It is noted that location c is aligned to an x axis of the image plane relative to the location a, and the location e is aligned at a first predetermined distance between the locations a and c and offset from the x axis by a second predetermined distance along the x axis of the image plane.

According to this design, the magenta 2, yellow 4 and black 6 marks each have intended locations that are aligned along a first axes with one of the cyan mark locations a, c and e and aligned along the other axis, but not aligned along the initial axis, with a second one of the mark locations a, c and d. In other words, magenta, yellow and black (Y, M and K) are aligned in both axes to a cyan test mark. Each of these non-cyan test marks (Y, M and K) can be used to detect its position relative to the cyan test marks for determining mis-registration of the corresponding image planes.

Figure 3A:
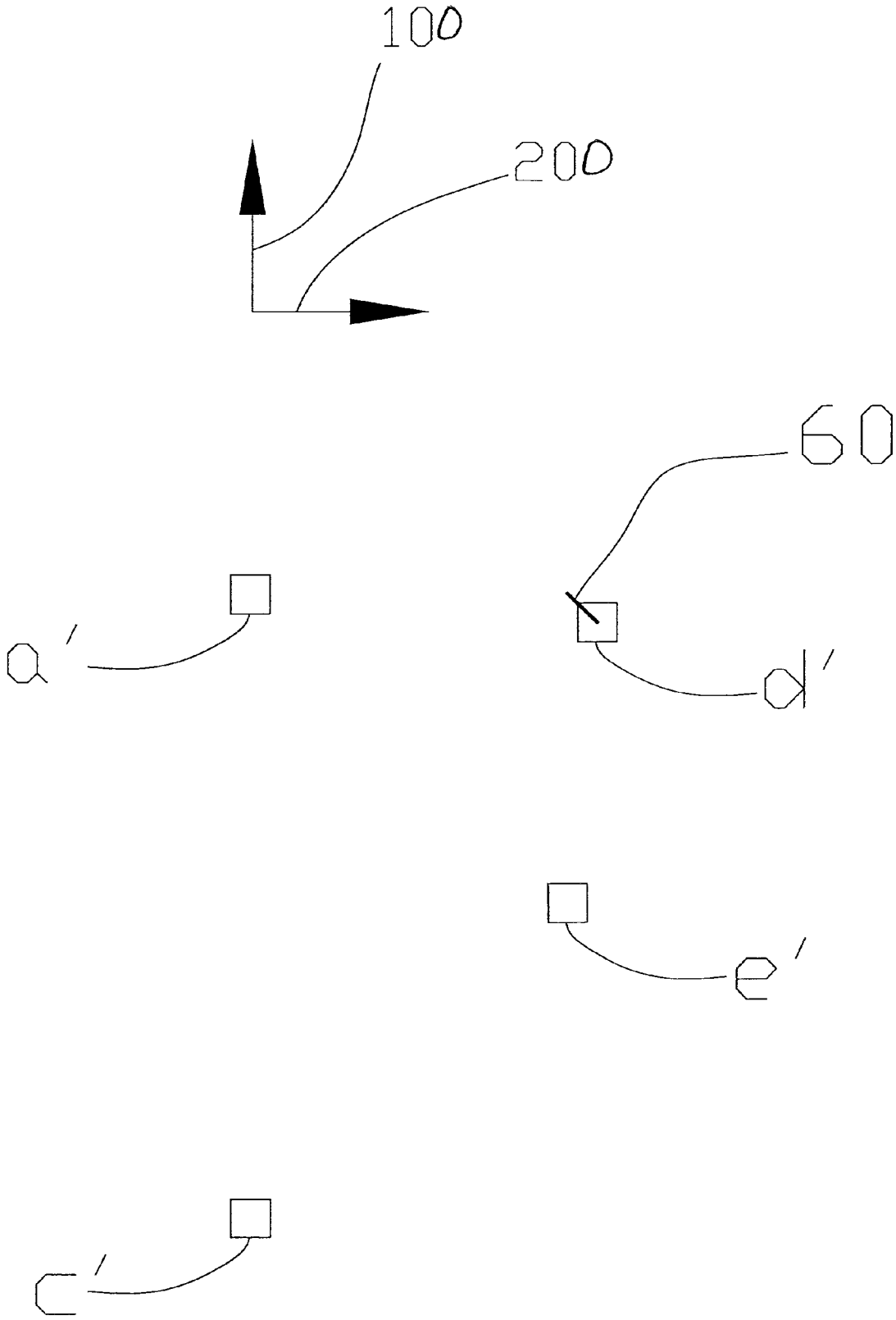
FIG. 3*a*-3*c* are detected locations of the printed marks at three different positions along the printing process.
Figure 3B:
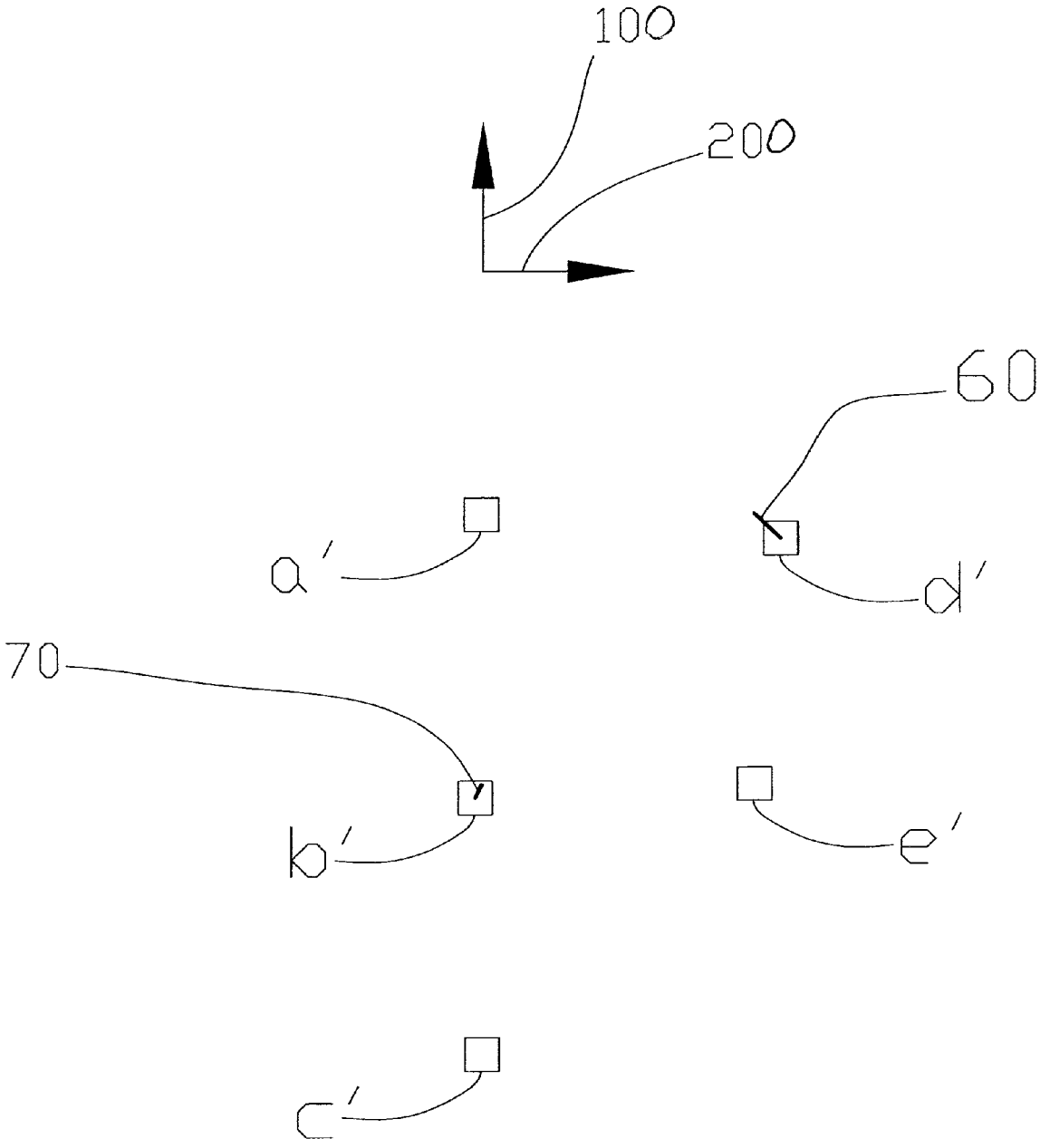
Figure 3C:
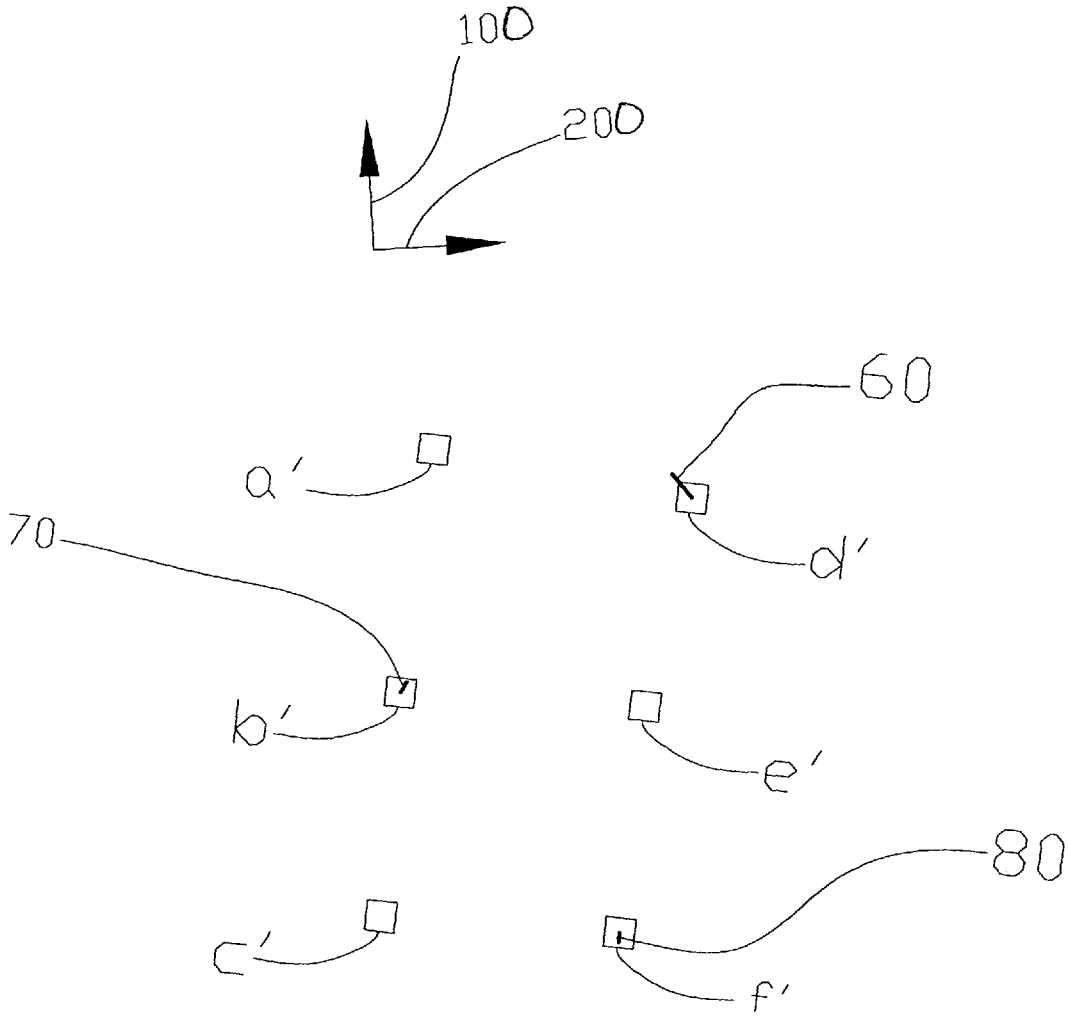

As shown in FIG. 1 an image capture device 50, 50*a*-50*c*, located down stream of two or more of the printheads is used to capture an image of the printed test pattern. Image analysis system 72 receives the captured images from the image capture devices and determines the detected locations of the marks in the image. A number of different algorithms may be employed to determine the detected locations. One such method identifies pixels whose pixels intensity value is above a threshold intensity level. A centroid position is then determined for the cluster of pixels over the threshold level that correspond to each detected test mark. The centroid position for the cluster of pixels is used for the detected location of the test mark. The algorithm may also employ filters to ensure that other artifacts in the captured image are not evaluated as test marks such as only considering detected clusters of pixels that meet appropriate size requirements. FIG. 3*a*-3*c* illustrate the images captured by image capture devices 50*a*-50*c*, respectively. The detected locations a', c', and e' of the test marks in the first image plane as well as detected location d' of the test mark in the second image plane, detected location b' of the test mark in the third image plane and detected location f' of the test mark of the fourth image plane are shown. As the intended locations b, d, and f had a defined spatial relationship to the intended locations, a, c, and e, the image analysis system can determine the deviation 60 of the detected location d' of the mark 4 of the second image plane, the deviation 70 of the detected location b' of mark 2 of the third image plane, and deviation 80 of the detected location f of mark 6 of the fourth image plane relative to the detected locations a', b' and c' of the marks 1, 3, and 5 of the first image plane from the captured image.

As marks 1, 3, and 5 are printed by a single printhead their positions relative to each other are well defined. Therefore the known spacing between marks 1, 3, and 5 can be employed to calibrate the imaging detector. Calibrating the imaging detector can include determining the magnification factor of the camera system in both directions. Calibration of the imaging detector can also include detection of and compensation for camera rotation errors. Locations a and c are aligned with the first axis of the image plane. If in the captured image of the test pattern, the detected locations a' and c' aren't aligned with the first axis, as is illustrated in FIG. 3*c*, it is indicative of a camera rotation error. From the measured locations of the three test marks of the reference color, it is straight forward to calculate the intended locations for the test marks for each of the non-reference colors to compensate for such camera rotation errors.

Once the deviations of the detected locations are determined for the test marks, the process controller can bring the image planes into registration by shifting the second, third, and fourth image planes relative to the first image by the appropriate amounts to account for the detected deviations. For example, in FIG. 3*a*, detected mark d' had a deviation 60 from the intended location. By shifting the second image plane up and to the left by the number of pixel spacing needed to account for the determined deviation, the second image plane can be properly registered relative to the first image plane. Similarly the third and fourth image planes can be registered to the first image plane by shifting those image planes by the amount to correct for the detected deviations of the detected locations b' and f. In a one embodiment for bringing the image planes into registration, the process controller 80, rather than electronically shifting the image planes relative to each other, sends commands to actuators, not shown, to physically shift the position of one or more of the printheads T2-T4 relative to the printhead T1. In still another embodiment, registration is achieved by a combination of the electronic shifting of one or more of the image planes and the physical shifting of one or more printheads.

Figure 4:
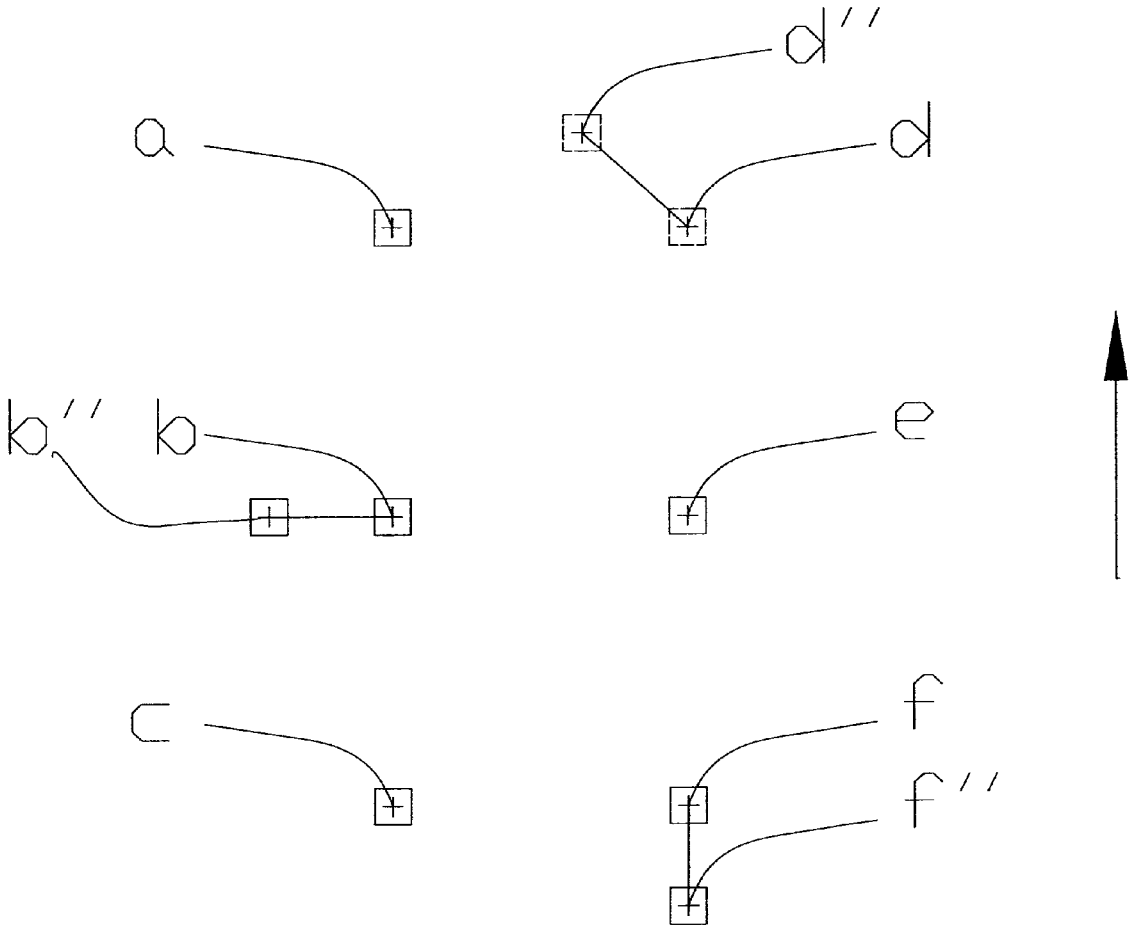
FIG. 4 is a diagram illustrating shifting of the test marks to correct for determined deviations.

To enable the image planes to be properly registered, it is necessary to unambiguously identify which test marks are printed by each of the printheads. If there are large registration errors, it is possible for example that the black test mark 6 might lie closer to location b than does the magenta test mark 2; this could lead to incorrectly associating test mark 6 with intended location b. This can be overcome by including in image plane registration sequence a mark identification stage. In the mark identification stage, a plurality of test patterns are printed and subsequently detected by the camera or image capture device. From one printed and detected test pattern to the next, at least one attribute of at least one of the test marks is altered in a defined and distinctive manner. For example, the intended position of one or more of the test marks can be shifted by distinctive amounts in one or more directions as shown in FIG. 4. Here mark intended location f is shifted a defined amount vertically to location f". Intended location b is shifted laterally to b", and location d has both vertical and horizontal shifts to d". Comparing the detected mark positions from one test pattern to another would enable the image processing system to unambiguously identify each test mark. Once each mark is properly identified, the registration of the image plane can proceed using the test pattern described above. An alternate attribute that can be altered, other than the position, is the size of a test mark in one or more directions. Another attribute of a test mark is its visibility. The test mark can be toggled on and off from one test pattern to the next so that it is present in one test pattern and not printed in the next. Each of these defined attribute changes from one printed test pattern to the next enable the individual test marks in the test patterns to be positively identified by the image processing system.

It is noted that, while the description above describes the printer in terms of four printheads each printing a separate color, the invention is not limited to printing systems having exactly four printheads. In the description of the test pattern, cyan served as the reference color with three test marks to which the marks of the other colors referenced. It must be understood that any of the printed colors could serve as the reference color. Furthermore, the invention is also not limited to a method for registering image planes of different colors. For example, rather than four printheads printing four image planes that correspond to four different colors, two or more of the four printheads could print separate image planes of the same color, such as when the print swaths of two printheads are to be stitched together to produce a wider overall print width.

The invention has been described in detail with particular reference to certain preferred embodiments thereof, but it will be understood that variations and modifications can be effected within the spirit and scope of the invention.

PARTS LIST

1-6 marks
10 printing system
20 print media
30 distance
40 distance
50*a*-50*c* image capture devices
60 deviation
62 drive roller
70 deviation
72 clock
80 process controller
90 encoder
100 axis
200 axis

The invention claimed is:

1. A method for aligning image planes in a multiple print-head system, wherein each print-head has an associated image plane, the method comprising the steps of:

(a) defining a test pattern having marks 1, 3 and 5 at three intended locations a, c and e in a first image plane associated with a first printhead in which the location c is aligned to a first axis of the image plane relative to the location a, and the location e is aligned at a first predetermined distance between the locations a and b and offset from the axis by a second predetermined distance along a second axis of the image plane;

(b) further defining the test pattern with a mark 4 at an intended location d in the second image plane associated with a second printhead such that the location d of the second image plane corresponds to a position aligned along a first axis with one of the mark locations a, b and c and aligned along the second axis, but not aligned along the first axis, with a second one of the mark locations a, b and c;

(c) printing the test pattern using the multiple print-head system on the test media;

(d) using an imaging detector to capture an image of the printed test pattern;

(e) determining detected locations a', c', and e' of the printed marks 1, 3, and 5 in the first image plane and detected location d' of printed mark 4 in the second image plane in the printed test pattern;

(f) determining deviation of the detected location d' of the mark 4 of the second image plane relative to the detected locations a', b' and c' of the marks 1, 3, and 5 of the first image plane from the captured image.

2. The method as in claim 1 further comprising the step of (g) shifting the second image plane relative to the first image plane to correct for the determined deviation.

3. The method as in claim 1 further comprising the step of using the detected locations a', b' and c' relative to the intended locations a, b and c in the first image plane to calibrate the imaging detector.

4. The method as in claim 1 further comprising the step of defining the test pattern with a mark 2 at intended location e in a third image plane such that the intended location e of the third image plane corresponds to a position aligned along a first axis with one of the intended locations a, b and c and aligned along the second axis, but not aligned along the first axis, with a second one of the intended locations a, b and c.

5. The method as in claim 1 further comprising the step of defining the test pattern with a mark 6 at intended location f in a fourth image plane such that the intended location f of the fourth image plane corresponds to a position aligned along the first axis with one of the intended locations a, b and c and aligned along the second axis, but not aligned horizontally, with a second one of the intended locations a, b and c.

6. The method as in claim 1 further comprising the step of defining each mark as a 5 pixel×5 pixel mark.

7. The method as in claim 1 wherein the first predetermine distance is a midway point or substantially a midway point between intended locations a and b.

8. The method as in claim 1 further comprising the step of modifying a position of the printhead printing the second image plane.

9. The method as in claim 1 further comprising the step of eliminating ambiguity as to which test mark is associated with which image plane by causing at least one attribute of at least one of the test marks to be altered in a defined and distinctive manner from one printed test pattern to another.

* * * * *